US010961095B2

(12) United States Patent
Hitchcock

(10) Patent No.: US 10,961,095 B2
(45) Date of Patent: Mar. 30, 2021

(54) ELECTRIC LIFT

(71) Applicant: Steven B. Hitchcock, Kennedy, NY (US)

(72) Inventor: Steven B. Hitchcock, Kennedy, NY (US)

( * ) Notice: Subject to any disclaimer, the term of this patent is extended or adjusted under 35 U.S.C. 154(b) by 0 days.

(21) Appl. No.: 16/560,179

(22) Filed: Sep. 4, 2019

(65) Prior Publication Data

US 2020/0071142 A1 Mar. 5, 2020

Related U.S. Application Data

(60) Provisional application No. 62/726,505, filed on Sep. 4, 2018.

(51) Int. Cl.
*B66F 9/02* (2006.01)

(52) U.S. Cl.
CPC ..... *B66F 9/02* (2013.01)

(58) Field of Classification Search
USPC ..... 414/408, 409
See application file for complete search history.

(56) References Cited

U.S. PATENT DOCUMENTS 3,217,913 A * 11/1965 Aldredge ..... B65F 3/04 414/408
6,071,058 A * 6/2000 Tetz ..... B65F 3/08 414/409
10,556,781 B2 * 2/2020 Jones ..... B66C 23/701

FOREIGN PATENT DOCUMENTS

GB 2370826 * 11/2000 ..... B66F 3/04

* cited by examiner

*Primary Examiner* — Ronald P Jarrett
(74) *Attorney, Agent, or Firm* — Simpson & Simpson, PLLC; Michael Nicholas Vranjes

(57) ABSTRACT

An electric lift, including a base including one or more wheels, a column connected to the base, the column including a first end, a second end, a front surface, a rear surface, and a line, the line being displaceable between the first and second ends, a motor connected to the line, and a carriage connected to the line, the carriage being operatively arranged to engage a container.

20 Claims, 13 Drawing Sheets

ELECTRIC LIFT

CROSS-REFERENCE TO RELATED APPLICATIONS

This application claims the benefit under 35 U.S.C. § 119(e) of U.S. Provisional Patent Application No. 62/726,505, filed Sep. 4, 2018, which application is incorporated herein by reference in its entirety.

FIELD

The present disclosure relates to electric lifts, and more particularly, to electric lifts that lift and dump a push cart.

BACKGROUND

A push cart or a wheelbarrow is a small hand-propelled vehicle, usually with just one wheel, designed to be pushed and guided by a single person using two handles at the rear. The term "wheelbarrow" is made of two words: "wheel" and "barrow." The term "barrow" is a derivation of the Old English "bearwe," which was a device used for carrying loads. The wheelbarrow is designed to distribute the weight of its load between the wheel and the operator, so enabling the convenient carriage of heavier and bulkier loads than would be possible were the weight carried entirely by the operator. As such it is a second-class lever. Traditional Chinese wheelbarrows, however, had a central wheel supporting the whole load. Use of wheelbarrows is common in the construction industry and in gardening. Typical capacity is approximately 100 liters (4 cubic feet) of material. A two-wheel type is more stable on level ground, while the almost universal one-wheel type has better maneuverability in small spaces, on planks, in water, or when tilted ground would throw the load off balance. The use of one wheel also permits greater control of the deposition of the load upon emptying.

Wheelbarrows and push carts are ideal when the load carried therein needs to be dumped on a ground or close to ground surface. However, when the load must be dumped into a dumpster or trash container, for example, the cart must be lifted to the top edge thereof and rotated so as to dump the contents therein. This poses an issue because the load may be quite heavy thereby requiring two or more operators to lift and dump the cart into the trash container. Additionally, often times, if not controlled correctly, the cart may end up in the trash container with the load. Lastly, hydraulic lifts require the use of unwanted hydraulic oil and fluid which can pollute construction sites such as school property and playgrounds.

Thus, there is a long felt need for an electric lift that can secure a push cart or wheelbarrow, and subsequently lift and dump the push cart or wheelbarrow into a container.

SUMMARY

According to aspects illustrated herein, there is provided an electric lift, comprising a base including one or more wheels, a column connected to the base, the column including a first end, a second end, a front surface, a rear surface, and a line, the line being displaceable between the first and second ends, a motor connected to the line, and a carriage connected to the line, the carriage being operatively arranged to engage a container.

According to aspects illustrated herein, there is provided an electric lift, comprising a base including one or more wheels, a column connected to the base, the column including a first end, a second end, a front surface, a rear surface, and a line, the line being displaceable between the first and second ends, a motor connected to the line, and a carriage connected to the line, the carriage including at least one arm operatively arranged to engage a container, wherein the electric lift is operatively arranged to lift and rotate the container.

According to aspects illustrated herein, there is provided an electric lift for lifting and dumping a container, the electric lift comprising a column, including a first end, a second end, a front surface, a rear surface, and a line, the line being displaceable between the first and second ends, a motor connected to the line, and a carriage connected to the line, the carriage being operatively arranged to engage the container.

According to aspects illustrated herein, there is provided an electric lift, comprising a base including one or more wheels, a column fixedly secured to the base, the column including a first sprocket rotatably arranged proximate a first end of the column, a second sprocket rotatably arranged proximate a second end of the column, and a line connected to the first and second sprockets, a motor connected to the first sprocket, and a carriage connected to the line, the carriage being arranged to engage a wheelbarrow.

These and other objects, features, and advantages of the present disclosure will become readily apparent upon a review of the following detailed description of the disclosure, in view of the drawings and appended claims.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements. It is to be understood that the claims are not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the claims.

Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice or testing of the example embodiments. The assembly of the present disclosure could be driven by hydraulics, electronics, pneumatics, and/or springs.

It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims. The term "approximately" is intended to mean values within ten percent of the specified value.

By "non-rotatably connected" elements, we mean that: the elements are connected so that whenever one of the elements rotate, all the elements rotate; and relative rotation between the elements is not possible. Radial and/or axial movement of non-rotatably connected elements with respect to each other is possible, but not required. By "rotatably connected" elements, we mean that the elements are rotatable with respect to each other.

Figure 1:
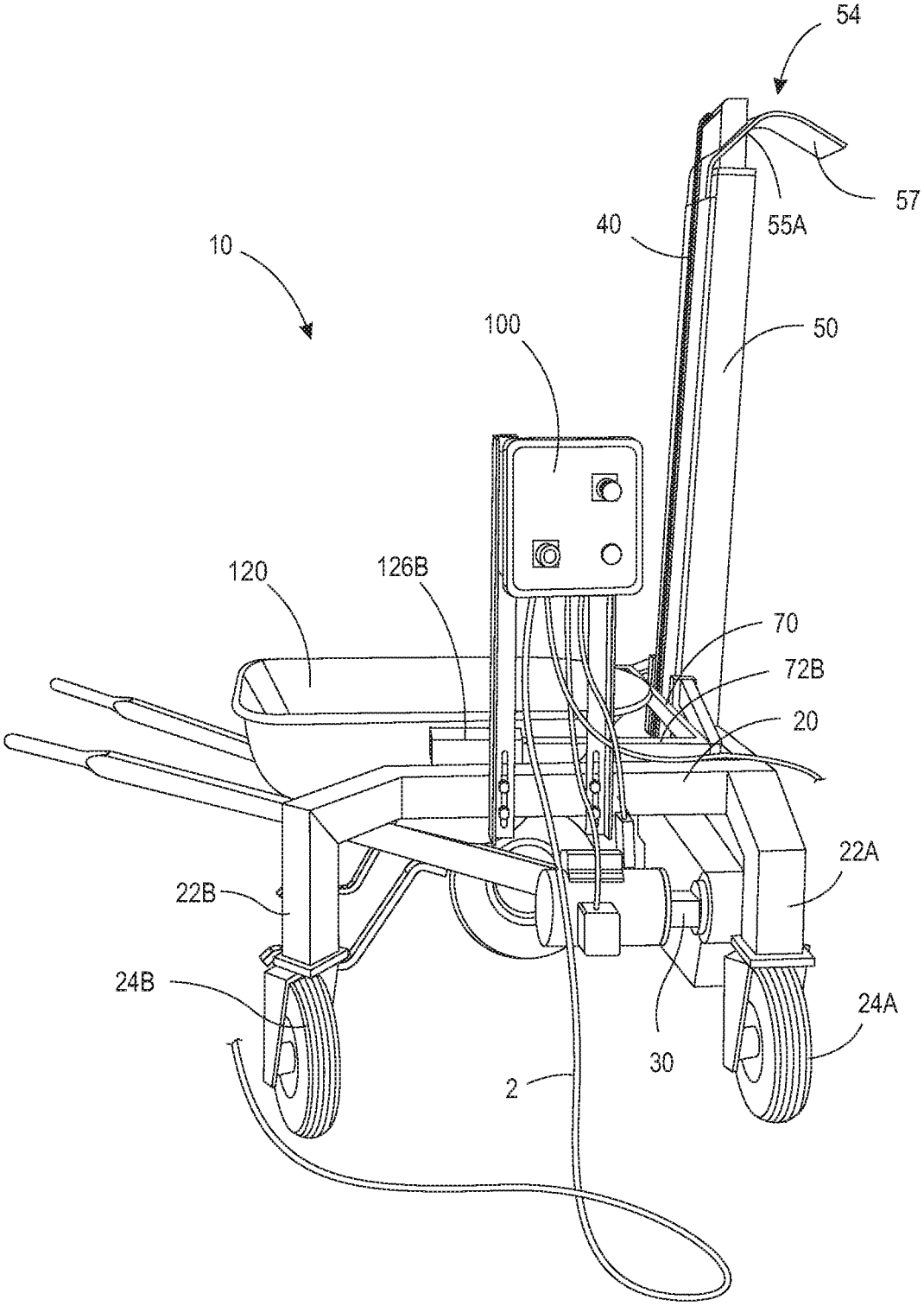
FIG. 1 is a side perspective view of an electric lift in a non-elevated position.
Figure 2:
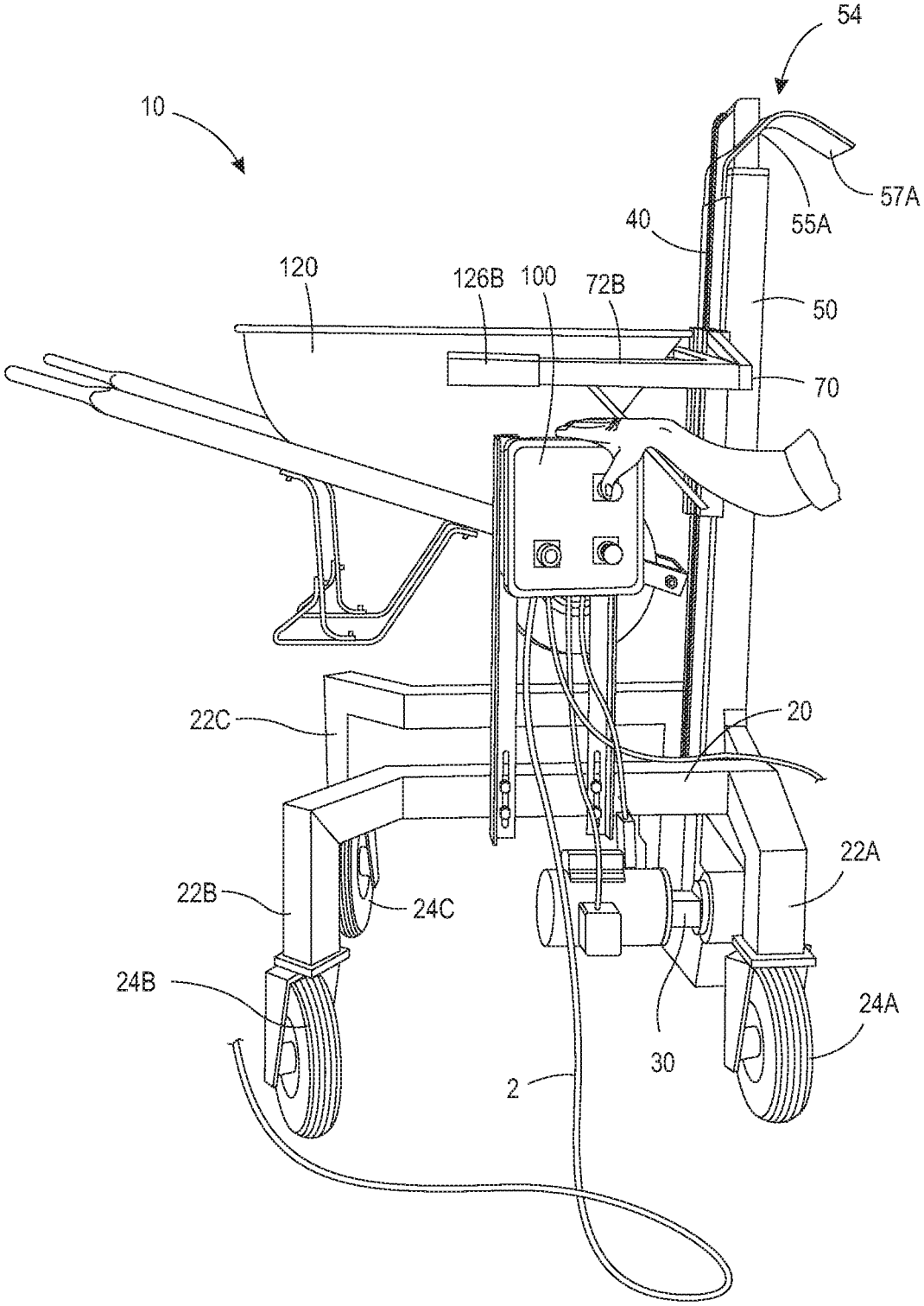
FIG. 2 is a side perspective view of the electric lift shown in FIG. 1, in a first partially elevated position.
Figure 3:
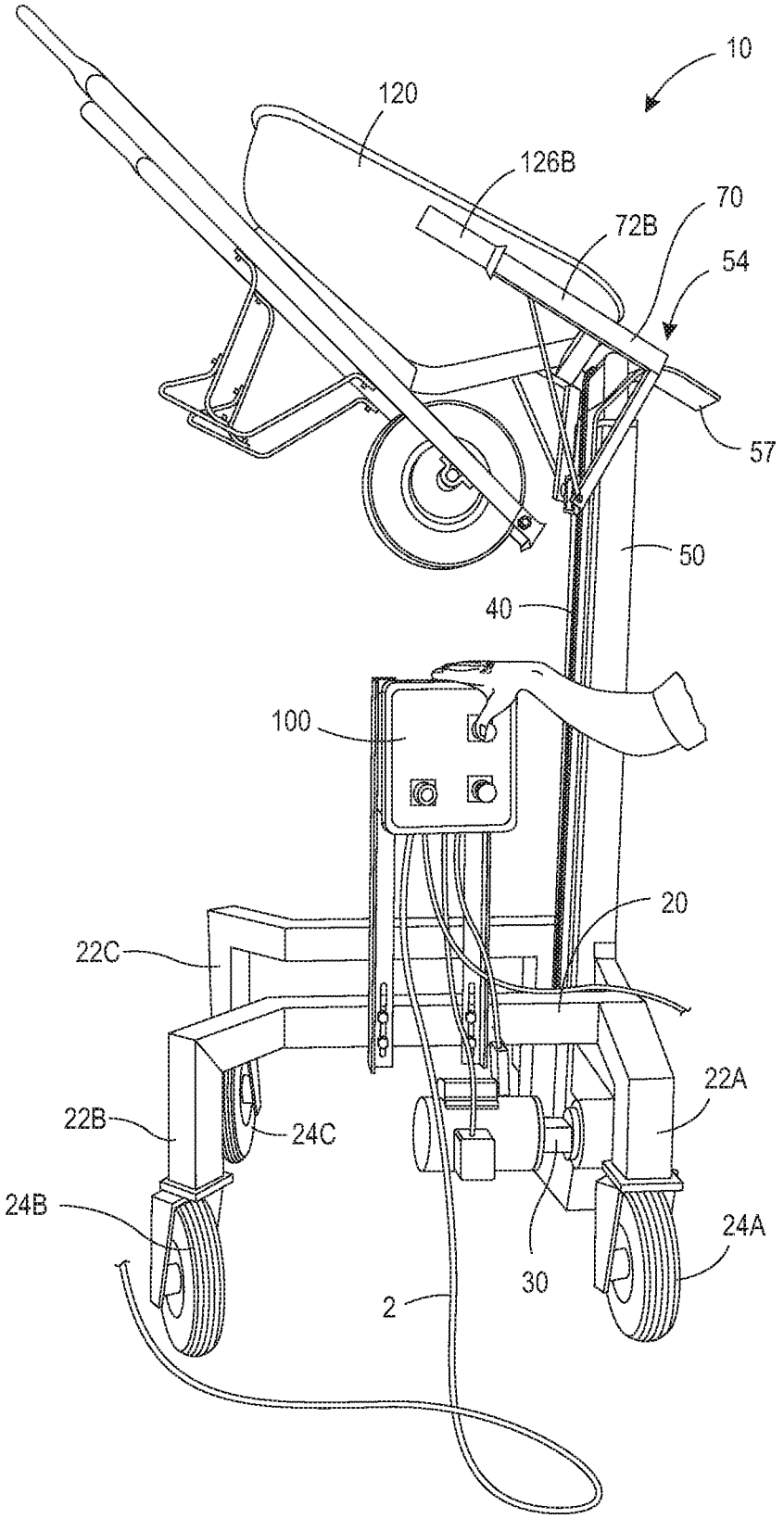
FIG. 3 is a side perspective view of the electric lift shown in FIG. 1, in a second partially elevated position.

Referring now to the figures, FIG. 1 is a side perspective view of electric lift 10 in a non-elevated position. FIG. 2 is a side perspective view of electric lift 10, in a first partially elevated position. FIG. 3 is a side perspective view of electric lift 10, in a second partially elevated position. The following description should be read in view of FIGS. 1-13.

Electric lift 10 generally comprises base 20, motor 30, column 50, carriage 70, and control panel 100. Electric lift 10 is arranged to lift and tilt wheelbarrow or container 120 and empty the contents therein into a container, for example, a trash container.

Base 20 comprises legs 22A-D and wheels 24A-D. In some embodiments, base 20 comprises one or more legs. In some embodiments, base 20 comprises one or more wheels. An important aspect of the present disclosure is that electric lift 10 is easily movable over any terrain, which aspect is accomplished though base 10 and wheels 24A-D. In some embodiments, all wheels swivel with respect to their respective legs. In some embodiments, two wheels swivel with respect to their respective legs. In some embodiments, one or more wheels swivel with respect to their legs.

Figure 4:
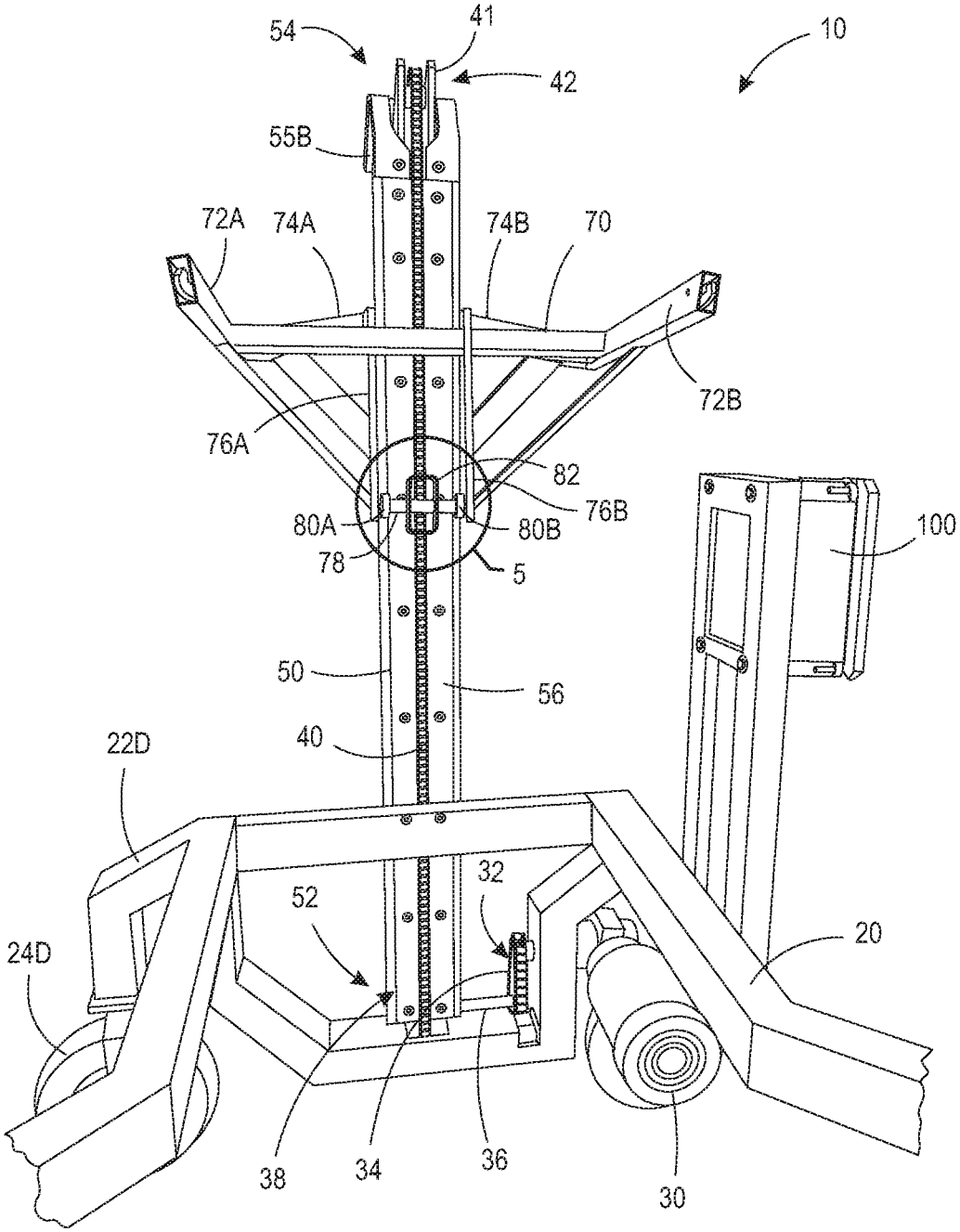
FIG. 4 is a front elevational view of the electric lift shown in FIG. 1.
Figure 5:
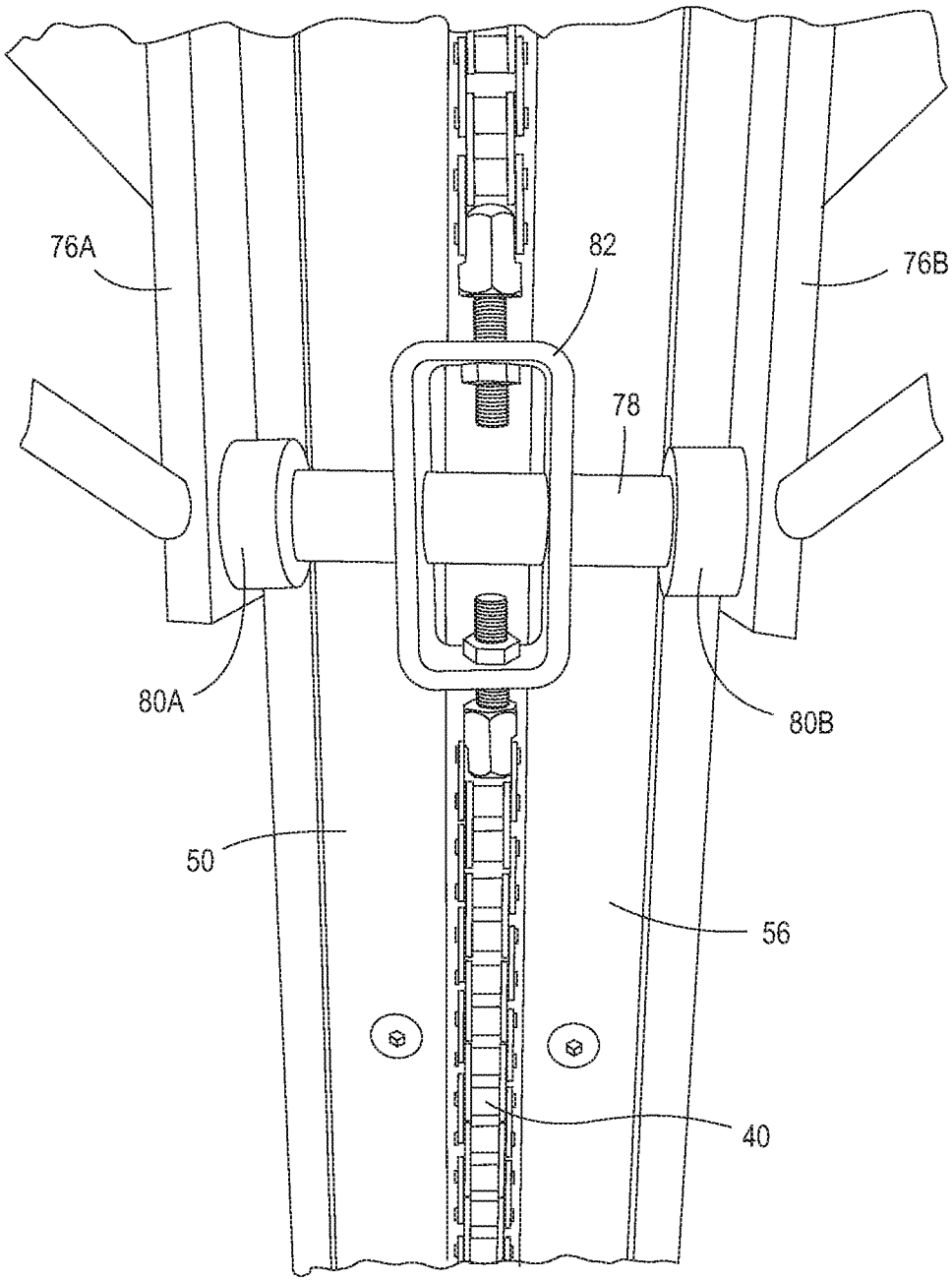
FIG. 5 is a detail view of the front rollers of the electric lift taken generally about detail 5 in FIG. 4.
Figure 6:
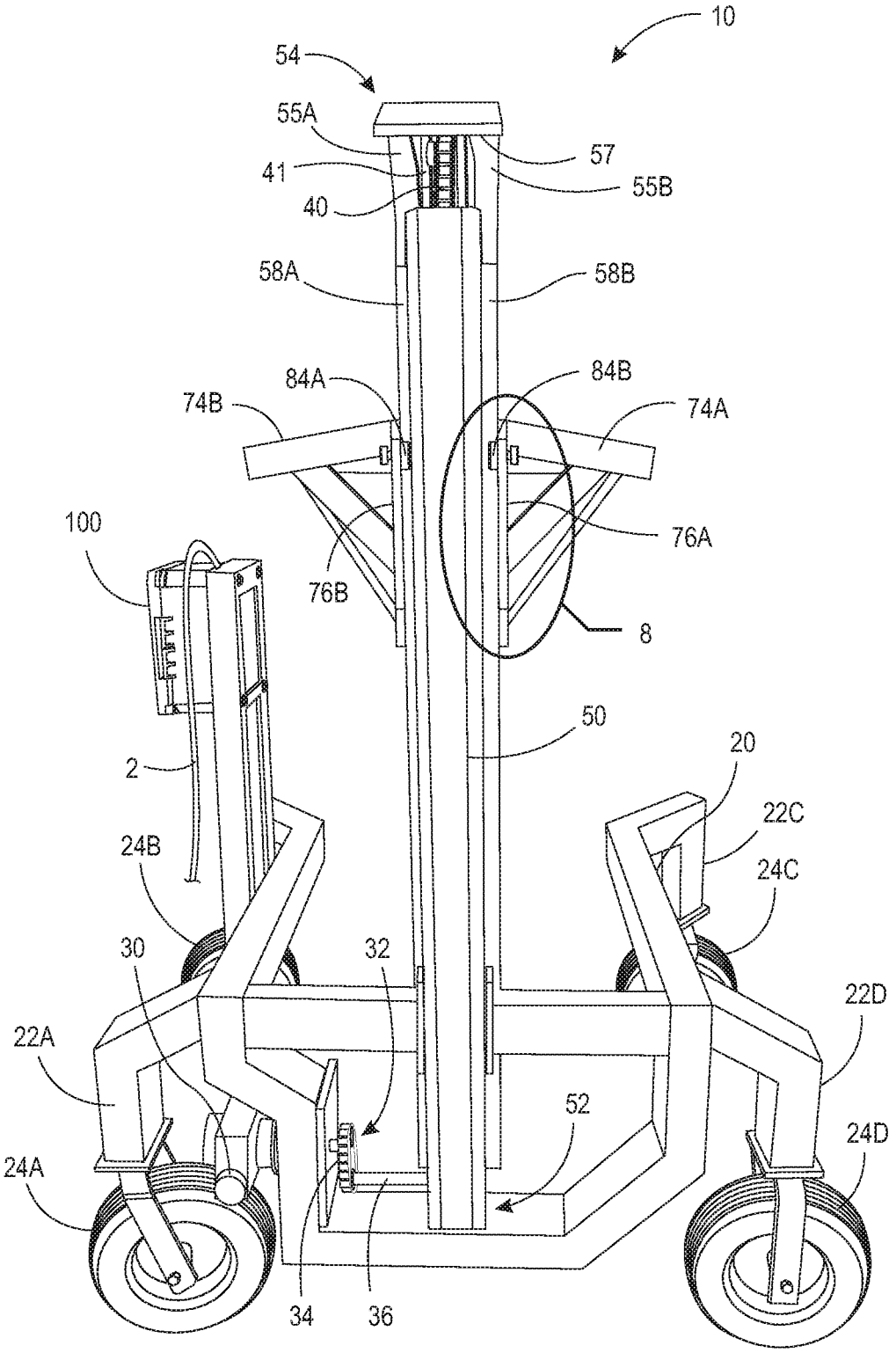
FIG. 6 is a rear elevational view of the electric lift shown in FIG. 1.
Figure 7:
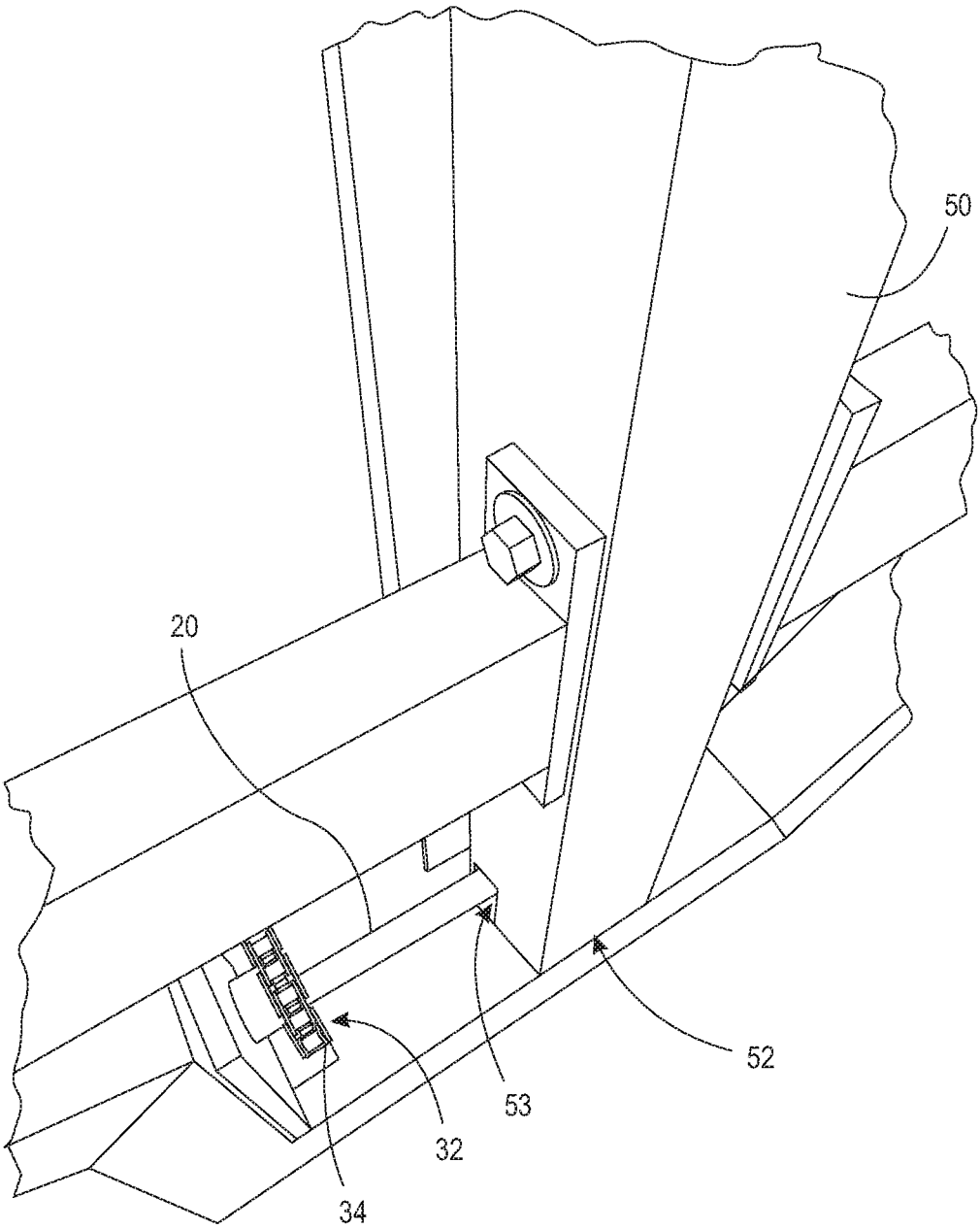
FIG. 7 is a rear perspective view of column and base of the electric lift shown in FIG. 1.
Figure 8:
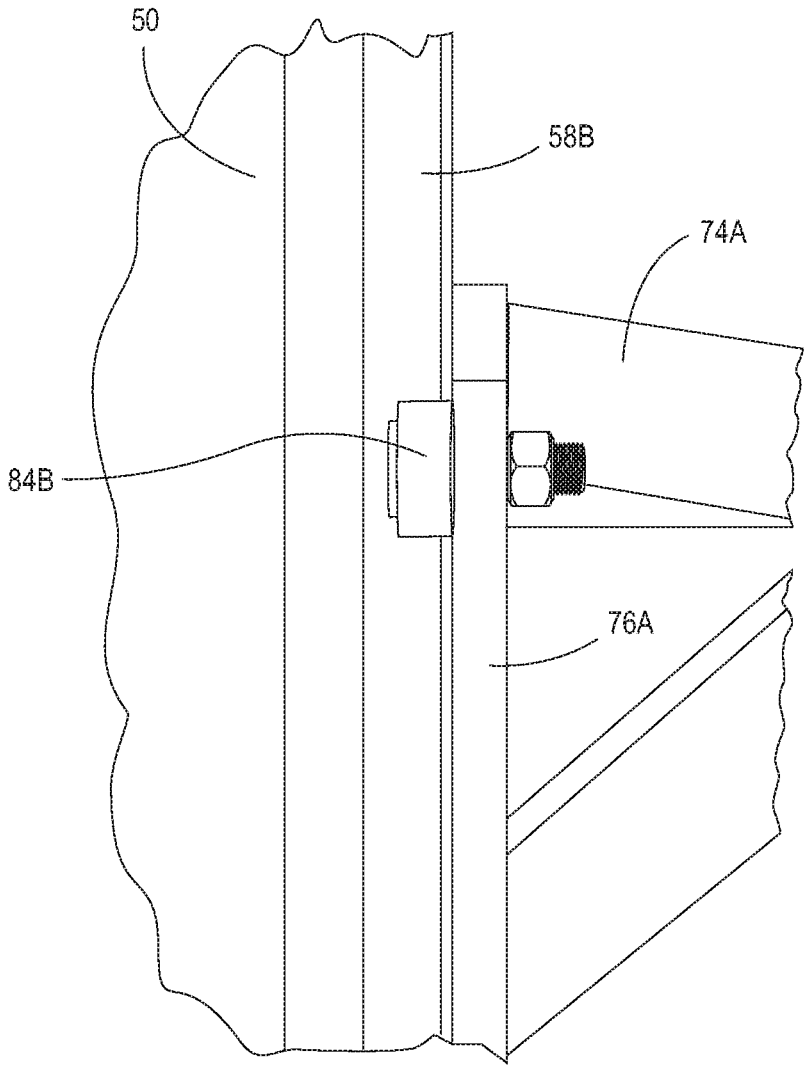
FIG. 8 is a detail view of a rear roller of the electric lift taken generally about detail 8 in FIG. 6.

FIG. 4 is a front elevational view of electric lift 10. FIG. 5 is a detail view of front rollers 80A and 80B of electric lift 10 taken generally about detail 5 in FIG. 4. FIG. 6 is a rear elevational view of electric lift 10. FIG. 7 is a rear perspective view of column 50 and base 20 of electric lift 10. FIG. 8 is a detail view of rear roller 84B of electric lift 10 taken generally about detail 8 in FIG. 6. The following description should be read in view of FIGS. 1-13.

Column 50 comprises end 52, end 54, front surface 56, and rear surfaces 58A and 58B. Column 50 is fixedly secured to base 20 via any suitable means, for example, bolts, rivets, brackets, welding, etc. Column 50 is arranged as a track on which carriage 70 moves up and down. It should be appreciated that column 50 also acts as a post or handle that can be used to move electric lift 10. For example, a user can grasp column 50 and roll electric lift 10 to a suitable location. It should also be appreciated that in some embodiments, electric lift 10 may be self-driving. For example, base 20, specifically wheels 24A-D, may comprise a drive mechanism as well as a steering mechanism, such that a user may only need to press a button(s) to move electric lift 10 to the desired location (e.g., next to a trash container). Furthermore, electric lift 10 may comprise a wireless receiver such that a user may drive the self-driving electric lift 10 via a remote controller (i.e., wireless transmitter). In some embodiments, column 50 is a linear beam. In some embodiments, column 50 is a curvilinear beam. In some embodiments, column 50 is an at least partially linear and at least partially curvilinear beam. The vertical height of column 50 may be any length suitable for elevating wheelbarrow or container 120 and dumping its contents into a container.

Motor 30 is secured to base 20 via any suitable means, for example, bolts, rivets, brackets, welding, etc. Motor 30 is connected to wheel (e.g., sprocket, pulley, etc.) 32. Wheel 32 is rotatably connected to base 20. Wheel 32 is connected to axel 36 via line 34. Axel 36 extends from wheel 32, through hole 53, and is further connected to wheel (e.g., sprocket, pulley, etc.) 38, which is rotatably arranged within column 50 proximate end 52. In some embodiments, wheel 38 is not arranged within column 50, but rotatably connected thereto (e.g., adjacent to column 50). Motor 30 may be an alternating current (AC) brushless motor, a direct current (DC) brushed motor, a DC brushless motor, a direct drive motor, a linear motor, a servo motor, a stepper motor, or any other suitable electric motor which drives line 40 from end 52 to end 54, and from end 54 to end 52, along column 50. In some embodiments, motor 30 is connected directly to wheel 38. Line 40 is arranged on column 50 and extends from wheel 38 proximate end 52 to wheel 42 (e.g., sprocket, pulley, etc.) arranged proximate end 54. In some embodiments, line 40 is arranged in a channel on surface 56. In some embodiments, line 40 is a chain. It should be appreciated that line 40 may comprise a cable, string, rope, strap, or any other tensile device suitable for displacing carriage 70 from end 52 to end 54, and from end 54 to end 52, along column 50. Motor 30 is arranged to displace carriage 70 from end 52 up to end 54, and then back down to end 52. Motor 30 is connected to control panel 100 via electrical conduit 2. Control panel 100 controls movement of motor 30 and the direction of line 40. It should be appreciated that any number of pulleys, sprockets, and lines (e.g., lines, cables, ropes, straps, etc.) may be implemented for use with motor 30 to suitably displace carriage 70 from end 52 to end 54, and from end 54 to end 52, along column 50.

Carriage 70 comprises arms 72A-B, supports 74A-B, plates 76A-B, axel 78, front rollers 80A-B, connector 82, and rear rollers 84A-B. Arms 72A and 72B are fixedly secured to supports 74A and 74B, respectively. Supports 74A and 74B are fixedly secured to plates 76A and 76B, respectively. Axel 78 is connected to connector 82 and plates 76A and 76B. Rollers 80A and 80B are rotatably connected to axel 78 and are arranged to engage surface 56 of column 50. As motor 30 drives line 40 up or down column 56, a substantial portion of the weight of the load carried by arms 72A and 72B is transferred to axel 78 and rollers 80A and 80B. Connector 82 is arranged to connect axel 78 to line 40. In some embodiments, connector 82 is a swiveling bracket that the "end-line-bolts" (i.e., the bolts connecting line 40 to the top and bottom of connector 82) fasten to, as shown in FIG. 5. Any suitable method of connecting rollers 80A and 80B to line 40 may be used. In some embodiments, rollers 80A-B are non-rotatably connected to axel 78. In such embodiments, rollers 80A-B and axel 78 are rotatably connected to connector 82 and plates 76A-B, for example, via a center axel running through rollers 80A-B and axel 78 from plate 76A to plate 76B. It should be appreciated that in some embodiments, carriage 70 comprises one or more rollers connected to line 40 and arranged to engage surface 56 of column 50, and that the present disclosure should not be limited to the use of only two front rollers. Similarly, rear rollers 84A and 84B are rotatably connected to plates 76B and 76A, respectively. As shown in FIGS. 6 and 8, roller 84A is rotatably connected to plate 76B and engages surface 58A of column 50. Roller 84B is rotatably connected to plate 76A and engages surface 58B of column 50. As motor 30 drives line 40 up or down column 50, a substantial portion of the weight of the load carried by arms 72A and 72B is transferred to rollers 84A and 84B. It should be appreciated that in some embodiments, carriage comprises one or more rollers connected to plate 76A and/or plate 76B and arranged to engage surface 58A and/or 58B of column 50, and that the present disclosure should not be limited to the use of only two rear rollers. Carriage 70 may further comprise any number of cross-beams and/or trusses for added strength or rigidity, as shown in the figures.

Figure 9:
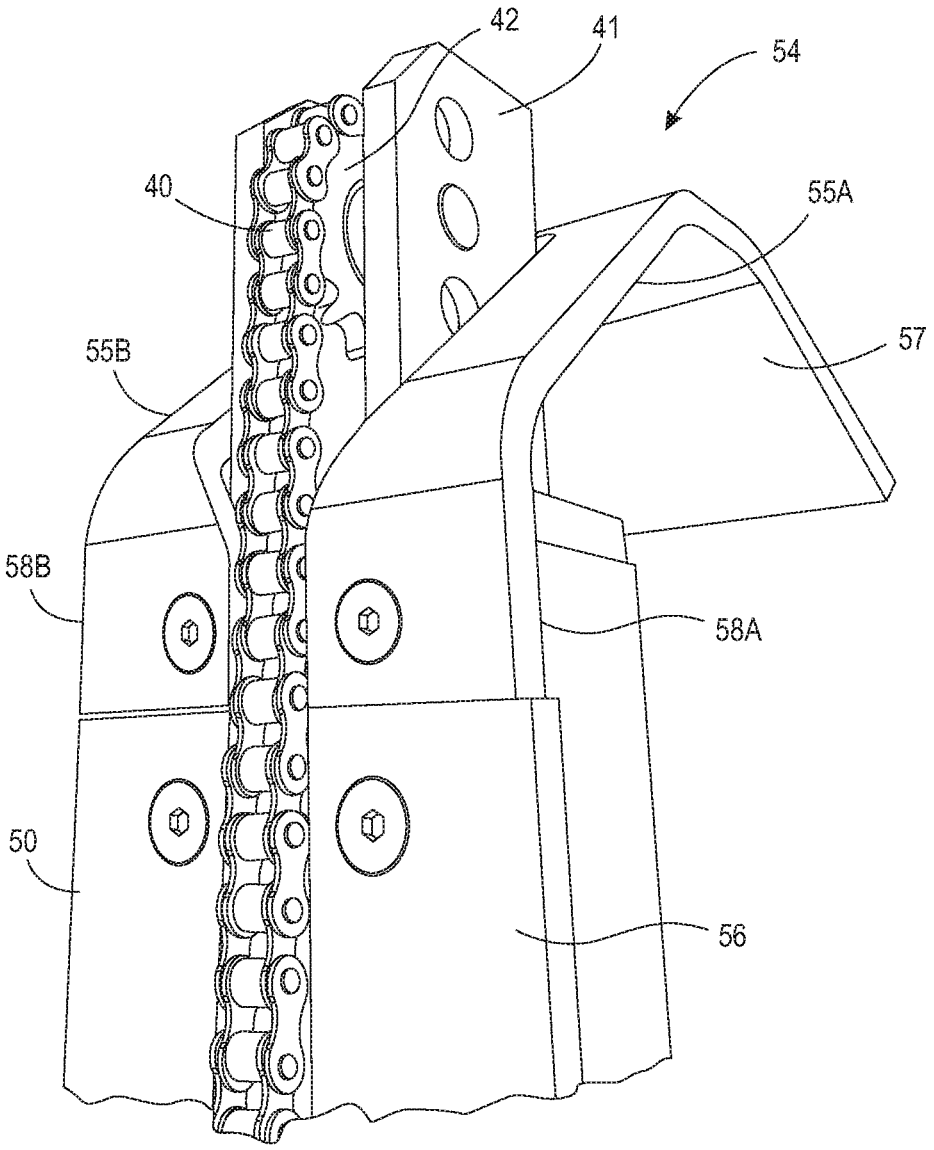
FIG. 9 is a perspective view of a line of the electric lift.

FIG. 9 is a perspective view of line 40 of electric lift 10. As shown, end 54 of column 50 has angled surfaces 55A and 55B, and angled surface 57. Rear rollers 84A and 84B are arranged to run up surfaces 58A and 58B, respectively, and onto angled surfaces 55A and 55B, respectively. Angled surfaces 55A and 55B are arranged at an angle relative to surfaces 58A and 58B, respectively, for example, at 45°. As carriage 70 continues to be driven up column 50 toward end 54 via line 40, rear rollers 84A and 84B run along angled surfaces 58A and 58B, respectively, and onto angled surface 57. Surface 57 is arranged at an angle relative to surfaces 55A and 55B, for example, at 90°. The arrangement of angled surfaces 55A-B and 57 allows wheelbarrow 120 to tip and dump out the contents therein. Also shown in the figures, and specifically FIG. 9, is idler wheel bracket 41, which holds wheel 42. Idler wheel bracket 41 can be adjusted to be any height or engage a column for adjustment to any height, for different sized trash containers. Idler wheel bracket 41 is secured to end 54 of column 50 using any suitable means, for example, bolts, rivets, screws, welding, etc. It should be appreciated that the engagement of idler wheel bracket 41 with column 50 allows column 50 to be adjusted to any suitable height, and as such column 50 is said to be adjustable in length.

Figure 10A:
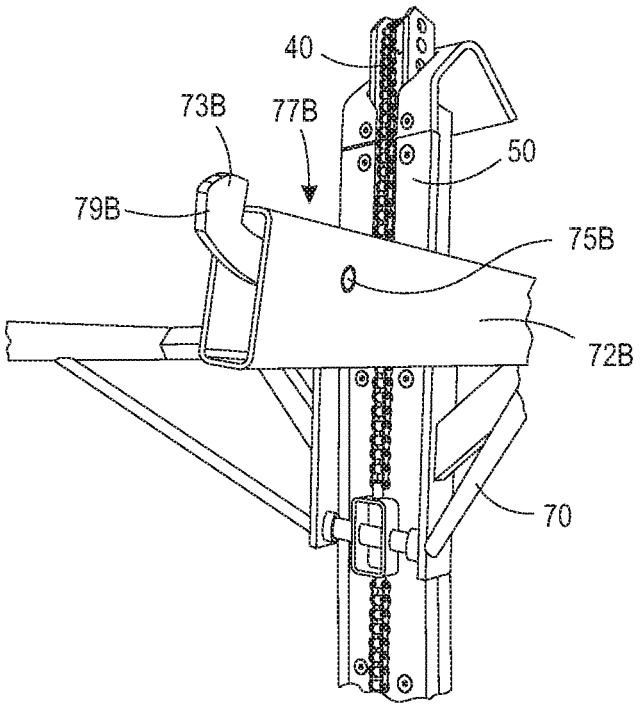
FIG. 10A is a perspective view of an arm with the safety latch in a locked position.
Figure 10B:
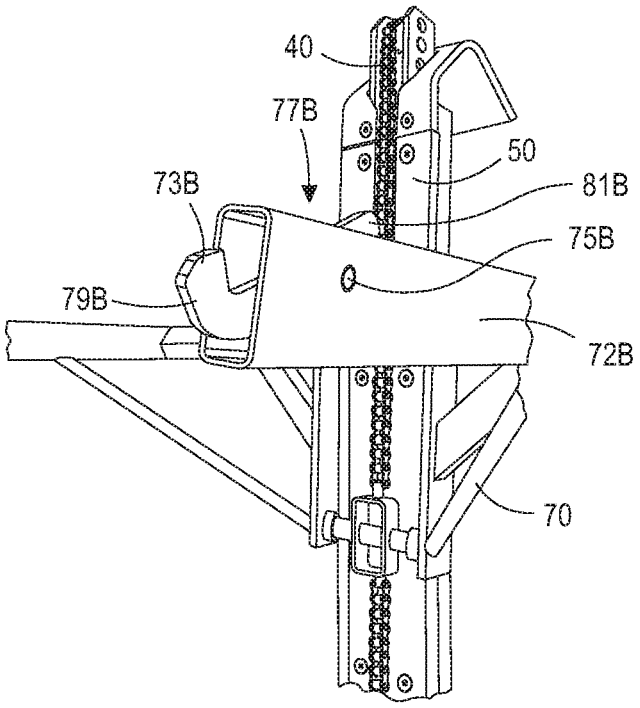
FIG. 10B is a perspective view of the arm shown in FIG. 10A with the safety latch in an unlocked position.

FIG. 10A is a perspective view of arm 72B of carriage 70 with latch or locking element 73B in a locked position. FIG. 10B is a perspective view of arm 72B with latch 73B in an unlocked position. As shown, latch 73B is rotatably connected to arm 72B via fastener 75B. Fastener 75B may be any attachment means suitable for rotatably connecting latch 73B to arm 72B, such as a bolt, rivet, screw, rod, bearing, etc. As shown in FIG. 10B, when in the unlocked position, end 81B of latch 73B extends up and out of hole 77B in arm 72B. When arm 72B is engaged with receiver 126B (see FIG. 11), end 81B is forced down into arm 72B which rotates latch 73B and forces end 79B of latch 73B up, effectively locking receiver 126B on arm 73B (i.e., end 79B acts as a flange that abuts against receiver 126B and/or maintains receiver 126B on arm 72B. It should be appreciated that arm 72A is substantially similar to arm 72B, and comprises latch or locking element 73A (not shown), fastener 75A (not shown), hole 77B (not shown). Latch 73A comprises end 79A (not shown) and end 81A (not shown). The description of arm 72B and latch 73B is substantially the same for arm 72A and latch 73A (not shown).

Figure 11:
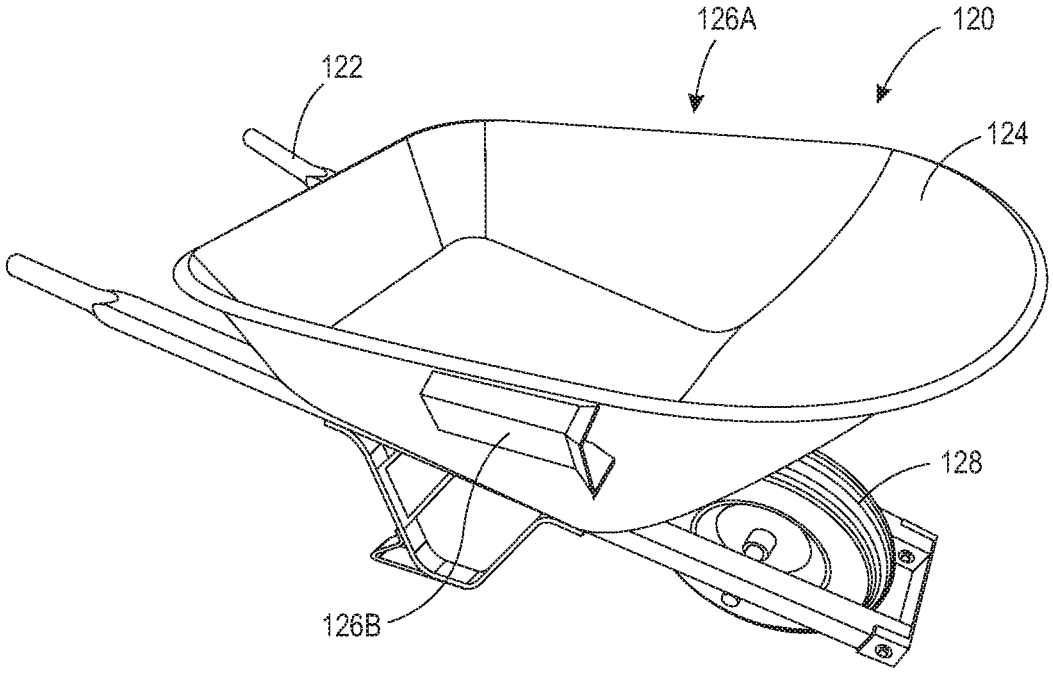
FIG. 11 is a perspective view of the wheelbarrow shown in FIG. 1.

FIG. 11 is a perspective view of wheelbarrow or container 120. Wheelbarrow 120 generally comprises one or more handles 122, body 124, and one or more wheels 128. Wheelbarrow 120 may further comprise receivers 126A (not shown) and 126B which engage arms 73A and 73B, respectively, such that electric lift 10 can lift and dump wheelbarrow 120. In some embodiments, arms 73A and 73B are arranged to lift and dump any standard wheelbarrow or push cart, and receivers 126A and 126B are not needed (i.e., arms 73A-B are operatively arranged to engage body 124). Receivers 126A and 126B may be connected to body 124 using any suitable means, for example, welding, bolts, screws, rivets, etc.

Figure 12:
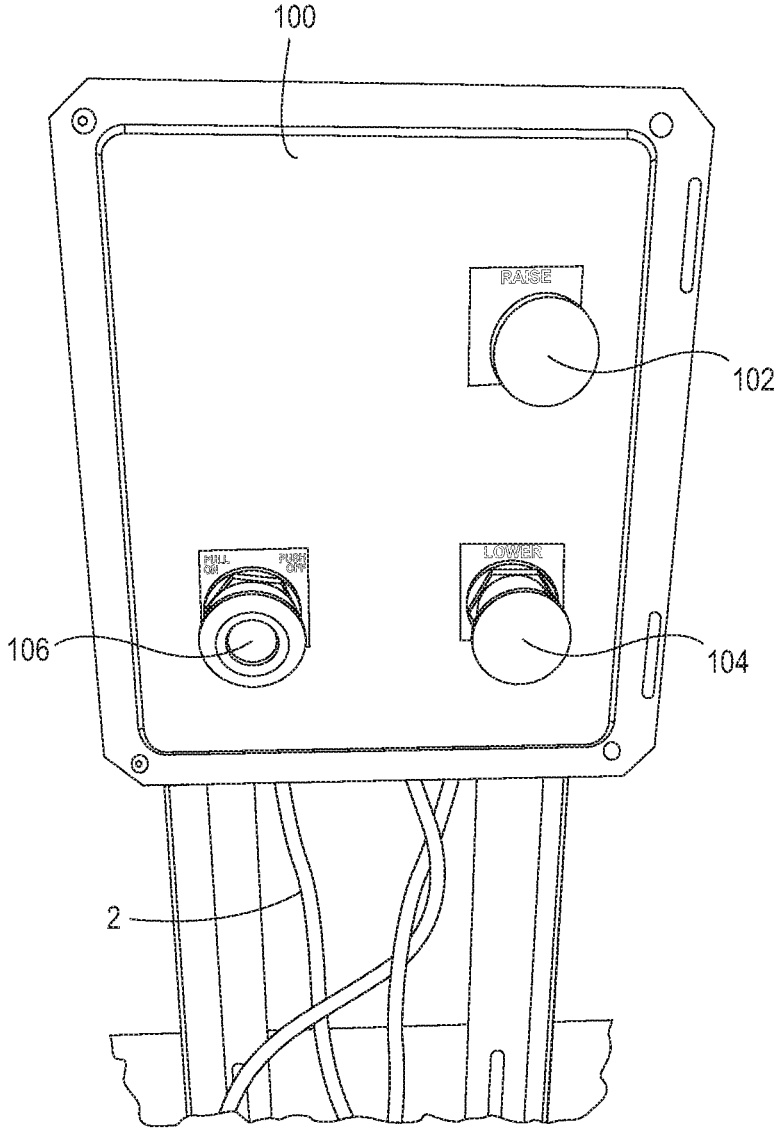
FIG. 12 is a front elevational view of the control panel shown in FIG. 1; and, FIG. 13 is a side elevational view of the electric lift shown in FIG. 1, in a fully elevated position.

FIG. 12 is a front elevational view of control panel 100. Control panel 100 is connected to a power source and to motor 30 via electrical conduit 2. Control panel 100 generally comprises raise button 102, lower button 104, and power button 106. Power button 106 can be switched on to provide electricity to motor 30. Power button 106 may be used as an emergency "kill switch," which disconnects all power to electric lift 10. Raise button 102, when engaged, directs motor 30 to rotate in a first circumferential direction in order to displace wheelbarrow 120 from end 52 of column 50 to end 54 of column 50 (i.e., generally vertically upward). Lower button 104, when pressed, directs motor 30 to rotate in a second circumferential direction, opposite the first circumferential direction, in order to displace wheelbarrow 120 from end 54 of column 50 to end 52 of column 50 (i.e., generally vertically downward). In some embodiments, control panel 100 may comprise an automatic lift, dump, and return feature wherein engaging a button once causes carriage 70 to displace all the way upward to the fully elevated position (see FIG. 13), optically hold for a preset period of time, and then displace all the way downward to the non-elevated position (see FIG. 1). In some embodiments, electric lift 10 further comprises a sensor which automatically stops motor 30 when carriage 70 is at a maximum altitude and/or minimum altitude. In some embodiments, control panel 100 can be operated remotely via wireless communication. In some embodiments, electric lift 100 may comprise a safety panel shield which separates the operator from the moving carriage 70.

Figure 13:
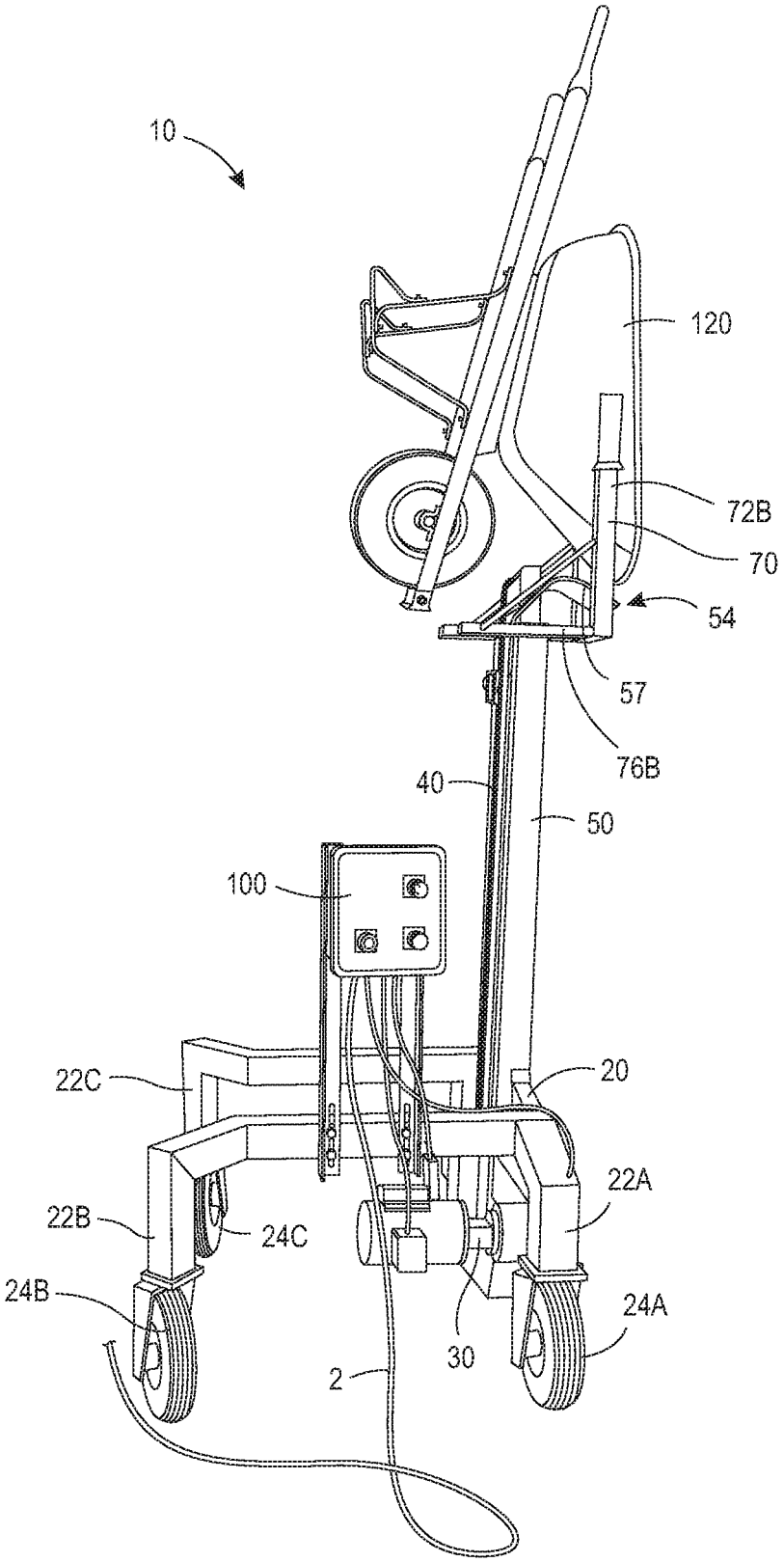

FIG. 13 is a side elevational view of electric lift 13 in a fully elevated position. As shown, wheelbarrow 120 is in a fully elevated and dumped (i.e., vertically tilted) position. Rear rollers 84A and 84B have separated from surface 57 as wheelbarrow 120 is rotated circumferentially. Front rollers 80A and 80B remain engaged with front surface 56. Wheelbarrow 120 may "spring" forward to dump the contents therein as rear rollers 84A and 84B separate from surface 57, which aids in the full removal of the contents within wheelbarrow 120.

It will be appreciated that various aspects of the disclosure above and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

REFERENCE NUMERALS

2 Electrical conduit
10 Electric lift
20 Base
22A Leg
22B Leg
22C Leg
22D Leg
24A Wheel
24B Wheel
24C Wheel
24D Wheel
30 Motor
32 Wheel (e.g., sprocket or pulley)
34 Line
36 Axel
38 Wheel (e.g., sprocket or pulley)
40 Line
41 Bracket
42 Wheel (e.g., sprocket or pulley)
50 Column
52 End
53 Hole
54 End
55A Surface
55B Surface
56 Surface
57 Surface
58A Surface
58B Surface
70 Carriage
72A Arm
72B Arm
73A Latch or locking mechanism (not shown)
73B Latch or locking mechanism
74A Support
74B Support
75A Fastener (not shown)
75B Fastener
76A Plate
76B Plate
77A Hole (not shown)
77B Hole
78 Axel
79A End
79B End
80A Roller
80B Roller
81A End
81B End
82 Connector
84A Roller
84B Roller
100 Control panel
102 Raise button
104 Lower button
106 Power button
120 Wheelbarrow or container
122 Handles
124 Body
126A Receiver
126B Receiver
128 Wheel

What is claimed is:

1. An electric lift, comprising:
a base including one or more wheels;
a column connected to the base, the column including:
a first end;
a second end;
a front surface;
a rear surface; and,
a line, the line being displaceable between the first and second ends;
a motor connected to the line; and,
a carriage connected to the line, the carriage including:
at least one arm; and,
a latch arranged at least partially within and rotatably connected to the at least one arm.

2. The electric lift as recited in claim 1, wherein the carriage further comprises at least one front roller arranged to engage the front surface.

3. The electric lift as recited in claim 2, wherein the carriage further comprises at least one rear roller arranged to engage the rear surface.

4. The electric lift as recited in claim 1, wherein the column further comprises a first angled surface connected to the rear surface proximate the second end, the first angled surface being arranged at an angle relative to the rear surface.

5. The electric lift as recited in claim 1, wherein the column is adjustable in length.

6. The electric lift as recited in claim 5, wherein the column further comprises a bracket adjustably connected to the second end.

7. The electric lift as recited in claim 1, wherein the line is connected to the first end via a first wheel and the second end via a second wheel.

8. The electric lift as recited in claim 7, wherein the first and second wheels are rotatably connected to the column.

9. The electric lift as recited in claim 1, wherein:
the latch comprises a first end and a second end, the second end extending out of the at least one arm;
in an unlocked state, the first end extends out of the at least one arm; and,
in a locked state, the first end is arranged within the at least one arm.

10. The electric lift as recited in claim 9, further comprising a container, wherein the container comprises a receiver and the at least one arm and the latch are operatively arranged to engage the receiver.

11. The electric lift as recited in claim 1, wherein the motor is operatively arranged to displace the carriage in a first direction along the column and in a second direction, opposite the first direction, along the column.

12. An electric lift, comprising:
a base including one or more wheels;
a column connected to the base, the column including:
a first end;
a second end;
a front surface;
a rear surface; and,
a line, the line being displaceable between the first and second ends, wherein the column is adjustable in length;
a motor connected to the line; and,
a carriage connected to the line, the carriage including at least one arm operatively arranged to engage a container;

wherein the electric lift is operatively arranged to lift and rotate the container.

13. The electric lift as recited in claim 12, wherein the carriage further comprises:

at least one front roller operatively arranged to engage the front surface; and, at least one rear roller operatively arranged to engage the rear surface.

14. The electric lift as recited in claim 13, wherein:

the column further comprises a first angled surface connected to the rear surface proximate the second end;

the first angled surface being arranged at a first angle relative to the rear surface; and, the at least one rear roller operatively arranged to engage the first angled surface.

15. The electric lift as recited in claim 12, further comprising:

a first wheel rotatably connected to the column proximate the first end; and, a second wheel rotatably connected to the column proximate the second end;

wherein the line is connected to the first and second wheels.

16. The electric lift as recited in claim 12, wherein the carriage further comprises a latch rotatably connected to the at least one arm, the latch being operatively arranged to secure the container on the at least one arm.

17. The electric lift as recited in claim 12, wherein the motor is operatively arranged to displace the carriage in a first direction along the column and in a second direction, opposite the first direction, along the column.

18. An electric lift for lifting and dumping a container, the electric lift comprising:

a column, including:

a first end;

a second end;

a front surface;

a rear surface;

a line, the line being displaceable between the first and second ends; and, a bracket adjustably connected to the first end, wherein the bracket is operatively arranged to adjust a height of the column;

a motor connected to the line; and, a carriage connected to the line, the carriage being operatively arranged to engage the container.

19. The electric lift as recited in claim 18, further comprising a base arranged on a ground surface via a plurality of wheels, wherein the column is connected to the base.

20. The electric lift as recited in claim 18, wherein the carriage comprises at least one arm including a latch arranged at least partially with and rotatably connected to the at least one arm.

* * * * *